US009583087B2

(12) United States Patent
Iwase

(10) Patent No.: US 9,583,087 B2
(45) Date of Patent: Feb. 28, 2017

(54) MUSICAL SOUND CONTROL DEVICE, MUSICAL SOUND CONTROL METHOD, PROGRAM STORAGE MEDIUM AND ELECTRONIC MUSICAL INSTRUMENT

(71) Applicant: CASIO COMPUTER CO., LTD., Shibuya-ku, Tokyo (JP)

(72) Inventor: Hiroshi Iwase, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/860,632

(22) Filed: Sep. 21, 2015

(65) Prior Publication Data

US 2016/0086590 A1 Mar. 24, 2016

(30) Foreign Application Priority Data

Sep. 22, 2014 (JP) ..... 2014-192534

(51) Int. Cl.
*G10H 1/32* (2006.01)
*G10H 3/00* (2006.01)
(Continued)

(52) U.S. Cl.
CPC ..... *G10H 1/344* (2013.01); *G10H 1/0556* (2013.01); *G10H 3/143* (2013.01); *G10H 2220/221* (2013.01); *G10H 2220/525* (2013.01)

(58) Field of Classification Search
CPC ..... G10H 1/34; G10H 1/344; G10H 7/008; G10H 1/00; G10H 1/348; G10H 2230/011;
(Continued)

(56) References Cited

U.S. PATENT DOCUMENTS 4,852,443 A * 8/1989 Duncan ..... G10H 1/0551 200/600
4,979,423 A 12/1990 Watanabe
(Continued)

FOREIGN PATENT DOCUMENTS

JP 01200289 A 8/1989
JP 04270385 A 9/1992
(Continued)

OTHER PUBLICATIONS

Japanese Office Action (and English translation thereof) dated Mar. 4, 2016, issued in counterpart Japanese Application No. 2014-192534.

*Primary Examiner* — Marlon Fletcher
(74) *Attorney, Agent, or Firm* — Holtz, Holtz & Volek PC

(57) ABSTRACT

A piezo pickup which detects a key depression vibration occurred by a key depression operation is provided on the center of the lower surface of a key switch board where key switches of a keyboard are arranged. A CPU acquires the key number of a depressed key and a distance between the key switch of this key number and the piezo pickup in response to the key depression operation, and controls the sound volume and the tone color of a musical sound at a pitch corresponding to the key number based on control data acquired by correcting the detection output level (piezo input envelope waveform) of the piezo pickup in accordance with the acquired distance.

15 Claims, 19 Drawing Sheets

(51) Int. Cl.

| | |
|---|---|
| ***G10H 1/34*** | (2006.01) |
| ***G10H 1/055*** | (2006.01) |
| ***G10H 3/14*** | (2006.01) |

(58) Field of Classification Search
CPC ..... G10H 1/0556; G10H 3/146; G10H 7/105; B06B 1/06; B06B 1/0644; G10G 1/00
See application file for complete search history.

(56) References Cited

U.S. PATENT DOCUMENTS

| | | | | |
|---|---|---|---|---|
| 6,362,412 | B1 | 3/2002 | Ura | |
| 2005/0034591 | A1 | 2/2005 | Chang | |
| 2008/0092720 | A1* | 4/2008 | Yamashita | G10C 3/16 84/600 |
| 2008/0127799 | A1* | 6/2008 | Yamashita | G10C 3/12 84/244 |
| 2014/0290467 | A1* | 10/2014 | Thee | G10H 1/0066 84/646 |

FOREIGN PATENT DOCUMENTS

| | | | |
|---|---|---|---|
| JP | 07210164 | A | 8/1995 |
| JP | 2000221980 | A | 8/2000 |
| JP | 2002258858 | A | 9/2002 |
| JP | 2005521922 | A | 7/2005 |
| WO | 2004015684 | A1 | 2/2004 |

* cited by examiner

FIG. 6A

DISTANCE TABLE DT

| KEY NUMBER OF DEPRESSED KEY | DISTANCE TO PIEZO PICKUP |
|---|---|
| KEY NUMBER (48:C3) | DISTANCE L (48) |
| KEY NUMBER (49:D3) | DISTANCE L (49) |
| ⋮ | ⋮ |
| KEY NUMBER (81:A5) | DISTANCE L (81) |

FIG. 6B

NORMALIZATION FACTOR TABLE NT

| DISTANCE TO PIEZO PICKUP | NORMALIZATION FACTOR G |
|---|---|
| DISTANCE L (48) | G(48) |
| DISTANCE L (49) | G(49) |
| ⋮ | ⋮ |
| DISTANCE L (81) | G(81) |

FIG. 8A

REACH TIME TABLE TT

| KEY NUMBER OF DEPRESSED KEY | REACH TIME OF VIBRATION OCCURRED BY KEY DEPRESSION |
|---|---|
| KEY NUMBER (48:C3) | REACH TIME T (48) |
| KEY NUMBER (49:D3) | REACH TIME T (49) |
| ⋮ | ⋮ |
| KEY NUMBER (81:A5) | REACH TIME T (81) |

FIG. 8B

DEPRESSED-KEY-COUNT CORRECTION FACTOR TABLE CT

| NUMBER OF DEPRESSED KEYS | CORRECTION FACTOR CC |
|---|---|
| 1 | CC(1)=1 |
| 2 | CC(2) |
| ⋮ | ⋮ |
| N | CC(N) |

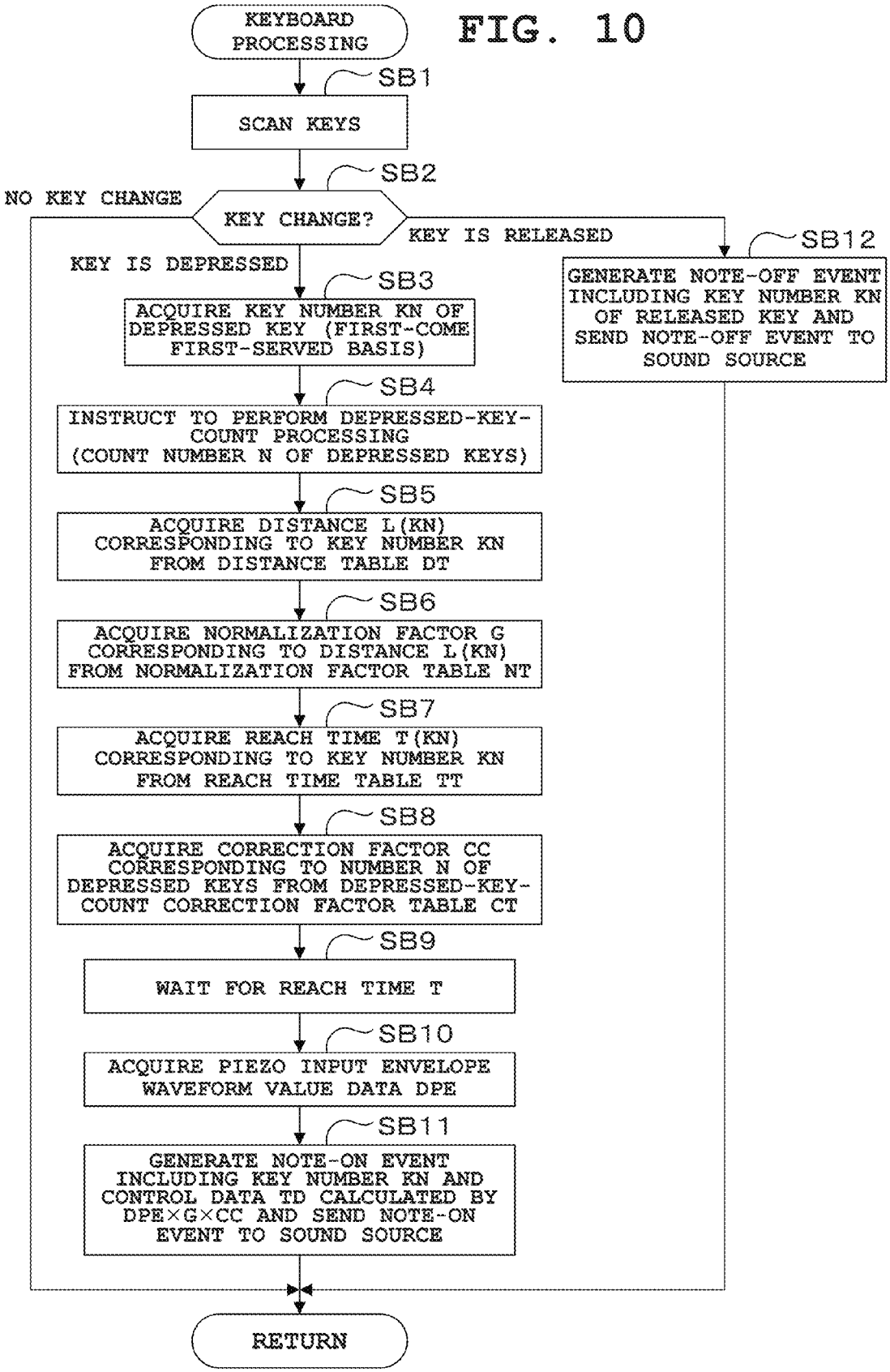
FIG. 10
KEYBOARD PROCESSING
SB1
SCAN KEYS
SB2
KEY CHANGE?
NO KEY CHANGE
KEY IS RELEASED
KEY IS DEPRESSED
SB12
GENERATE NOTE-OFF EVENT INCLUDING KEY NUMBER KN OF RELEASED KEY AND SEND NOTE-OFF EVENT TO SOUND SOURCE
SB3
ACQUIRE KEY NUMBER KN OF DEPRESSED KEY (FIRST-COME FIRST-SERVED BASIS)
SB4
INSTRUCT TO PERFORM DEPRESSED-KEY-COUNT PROCESSING (COUNT NUMBER N OF DEPRESSED KEYS)
SB5
ACQUIRE DISTANCE L(KN) CORRESPONDING TO KEY NUMBER KN FROM DISTANCE TABLE DT
SB6
ACQUIRE NORMALIZATION FACTOR G CORRESPONDING TO DISTANCE L(KN) FROM NORMALIZATION FACTOR TABLE NT
SB7
ACQUIRE REACH TIME T(KN) CORRESPONDING TO KEY NUMBER KN FROM REACH TIME TABLE TT
SB8
ACQUIRE CORRECTION FACTOR CC CORRESPONDING TO NUMBER N OF DEPRESSED KEYS FROM DEPRESSED-KEY-COUNT CORRECTION FACTOR TABLE CT
SB9
WAIT FOR REACH TIME T
SB10
ACQUIRE PIEZO INPUT ENVELOPE WAVEFORM VALUE DATA DPE
SB11
GENERATE NOTE-ON EVENT INCLUDING KEY NUMBER KN AND CONTROL DATA TD CALCULATED BY DPE×G×CC AND SEND NOTE-ON EVENT TO SOUND SOURCE
RETURN

FIG. 15A

DISTANCE TABLE DT

| DEPRESSED PAD SWITCH NUMBER | DISTANCE TO PIEZO PICKUP |
|---|---|
| PS1 | DISTANCE L (PS1) |
| PS2 | DISTANCE L (PS2) |
| PS3 | DISTANCE L (PS3) |
| PS4 | DISTANCE L (PS4) |

FIG. 15B

NORMALIZATION FACTOR TABLE NT

| DISTANCE TO PIEZO PICKUP | NORMALIZATION FACTOR G |
|---|---|
| DISTANCE L (PS1) | G(PS1) |
| DISTANCE L (PS2) | G(PS2) |
| DISTANCE L (PS3) | G(PS3) |
| DISTANCE L (PS4) | G(PS4) |

FIG. 16

REACH TIME TABLE TT

| DEPRESSED PAD SWITCH NUMBER | VIBRATION REACH TIME |
|---|---|
| PS1 | DISTANCE L (PS1) |
| PS2 | DISTANCE L (PS2) |
| PS3 | DISTANCE L (PS3) |
| PS4 | DISTANCE L (PS4) |

MUSICAL SOUND CONTROL DEVICE, MUSICAL SOUND CONTROL METHOD, PROGRAM STORAGE MEDIUM AND ELECTRONIC MUSICAL INSTRUMENT

CROSS-REFERENCE TO RELATED APPLICATION

This application is based upon and claims the benefit of priority from the prior Japanese Patent Application No. 2014-19253.4, filed Sep. 22, 2014, the entire contents of which are incorporated herein by reference.

BACKGROUND OF THE INVENTION

1. Field of the Invention

The present invention relates to a musical sound control device suitable for use in an electronic keyboard instrument including a keyboard and an electronic percussion instrument including a pad, a musical sound control method, a program storage medium, and an electronic musical instrument.

2. Description of the Related Art

Conventionally, a touch response method for controlling the sound volume of an emitted musical sound in accordance with a key touch or the like (the manner of depressing a key) has been known. Known examples of the touch response method include a method of controlling an initial touch by detecting a key depression speed when a key is depressed or controlling an after-touch by detecting an operation of further strongly (deeply) depressing a key with the key being depressed.

In a musical sound control device for touch response, in general, an initial touch is controlled by a key depression speed detected based on an ON-time difference between two key switches provided in keys on a keyboard, and an after-touch is controlled by the detection of the strength of a key depression operation by a pressure-sensitive sensor provided in each key on the keyboard. An example of the technology of controlling an after-touch by the detection of the strength of a key depression operation by a pressure-sensitive sensor provided in each key on a keyboard is disclosed in Japanese Patent Application Laid-open (Kokai) Publication No. 07-210164.

In this technology, there is a problem in that a pressure-sensitive sensor is required to be provided for each key on a keyboard and processing for uniformly adjusting the sensitivities of the respective pressure-sensitive sensors is required, which causes an increase in the manufacturing cost.

The present invention has been conceived in light of the above-described problem. An object of the present invention is to provide a musical sound control device by which touch control can be actualized without an increase in manufacturing cost, a musical sound control method, a program storage medium, and an electronic musical instrument.

SUMMARY OF THE INVENTION

In accordance with one aspect of the present invention, there is provided a musical sound control device comprising: a plurality of operation detectors which detect operations performed on a plurality of operators, respectively; a detection element which detects a level of a physical phenomenon occurred by each operation performed on the plurality of operators; and a control unit which controls a musical sound to be emitted corresponding to one of the plurality of operators detected by the plurality of operation detectors, based on (i) the detected level of the physical phenomenon and (ii) a distance between one of the plurality of operators detected by one of the plurality of the operation detectors and the detection element.

In accordance with another aspect of the present invention, there is provided a musical sound control method for a musical sound control device including an operation detector which detects whether any one of a plurality of operators has been operated and a detection element which detects a level of a physical phenomenon occurred by operation of at least one of the plurality of operators, comprising: a step of acquiring the level of the physical phenomenon related to an operator detected by the detection element; and a step of controlling a musical sound to be emitted, based on the detected level of the physical phenomenon and a distance between the operator detected to have been operated by the operation detector and the detection element.

In accordance with another aspect of the present invention, there is provided a non-transitory computer-readable storage medium having a program stored thereon that is executable by a computer for a musical sound control device including an operation detector which detects whether any one of a plurality of operators has been operated and a detection element which detects a level of a physical phenomenon occurred by operation of at least one of the plurality of operators, the program being executable by the computer to actualize functions comprising: processing for acquiring the level of the physical phenomenon related to an operator detected by the detection element; and processing for controlling a musical sound to be emitted, based on the detected level of the physical phenomenon and a distance between the operator detected to have been operated by the operation detector and the detection element.

In accordance with another aspect of the present invention, there is provided an electronic musical instrument comprising: a plurality of operators; the above-described musical sound control device; and a sound source which emits the musical sound controlled by the musical sound control device at a pitch corresponding to the operator in response to operation of the operator.

In accordance with another aspect of the present invention, there is provided an electronic musical instrument comprising: a plurality of operators; the above-described musical sound control device; and a sound source which emits the musical sound controlled by the musical sound control device in response to operation of the operator.

In accordance with another aspect of the present invention, there is provided a musical sound control device comprising: a plurality of operation detectors which detect operations performed on a plurality of operation areas located differently from one another, respectively; a detection element which detects a level of a physical phenomenon generated by an operation performed on one of the plurality of operation areas; and a control unit which controls a musical sound to be emitted based on (i) a distance between one of the plurality of operation areas detected to have been operated by one of the plurality of operation detectors and the detection element and (ii) the level of the physical phenomenon detected by the detection element.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 6A and FIG. 6B are diagrams showing a distance table DT and a normalization factor table NT stored in the RAM 18;

FIG. 8A and FIG. 8B are diagrams showing an example of a reach time table TT and an example of a depressed-key-count correction factor table CT stored in the RAM 18;

FIG. 10 is a flowchart of operations in keyboard processing in the first embodiment;

FIG. 15A and FIG. 15B are diagrams showing an example of a distance table DT and an example of a normalization factor table NT stored in the RAM 18 according to the second embodiment;

FIG. 16 is a diagram showing an example of a reach time table TT stored in the RAM 18 according to the second embodiment;

DETAILED DESCRIPTION OF THE PREFERRED EMBODIMENTS

Hereafter, embodiments of the present invention are described with reference to the drawings.

First Embodiment

A. Outer Appearance and Structure (1) Outer Appearance

Figure 1:
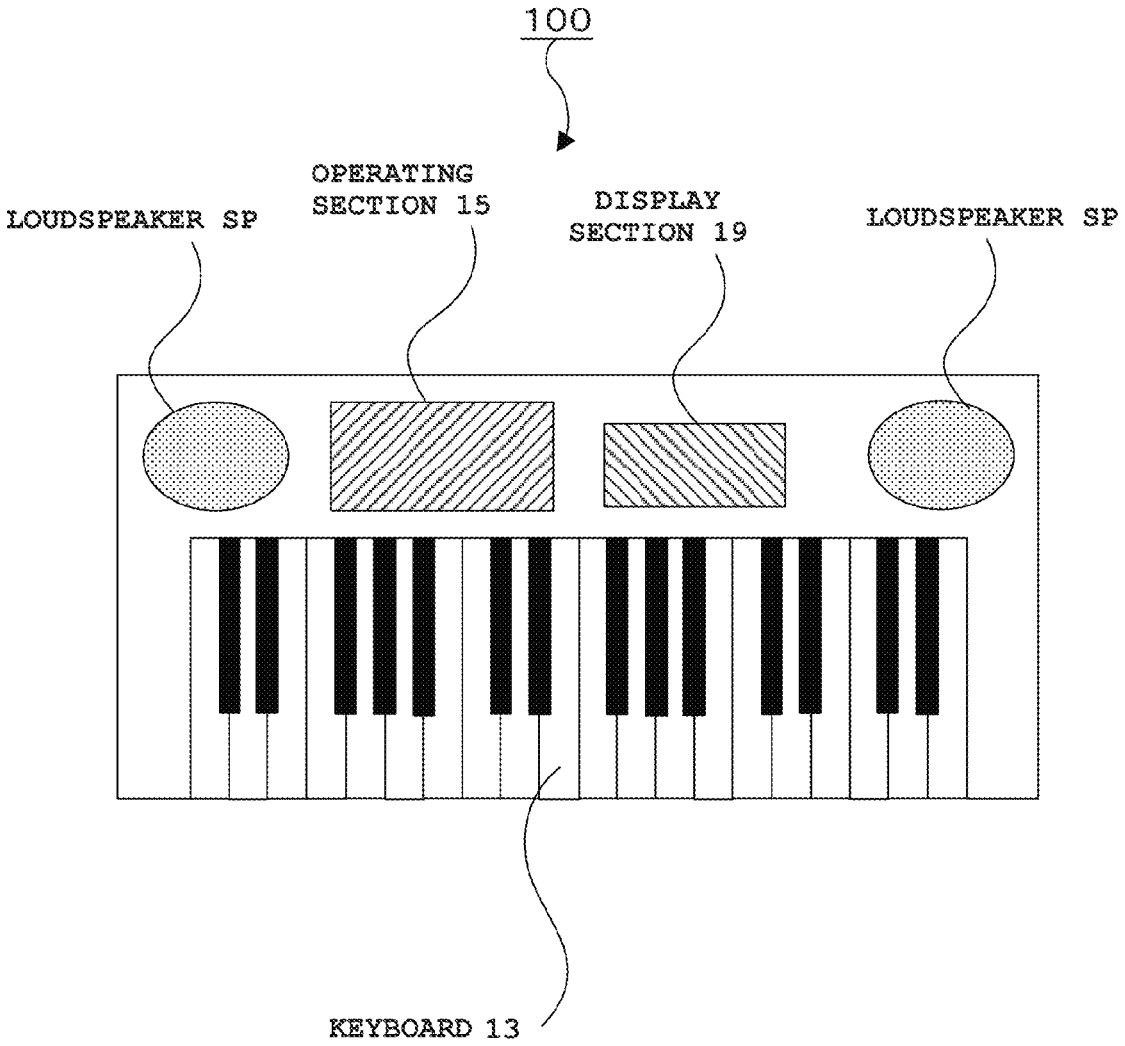
FIG. 1 is an external view of the outer appearance of an electronic musical instrument 100 according to a first embodiment.

FIG. 1 is an external view of the outer appearance of an electronic musical instrument 100 including a musical sound control device according to a first embodiment of the present invention. The electronic musical instrument 100 depicted in the drawing has a rectangular-shaped housing, and includes a keyboard 13 arranged along the longitudinal direction on its front surface. On the left and right end sides of an operation panel provided in an area above this keyboard 13, a pair of loudspeakers SP is arranged. At the center, various operation switches constituting an operating section 15, and a display section 19 for displaying the setting status and the operation status of the musical instrument are arranged.

(2) Structure

Figure 2A:
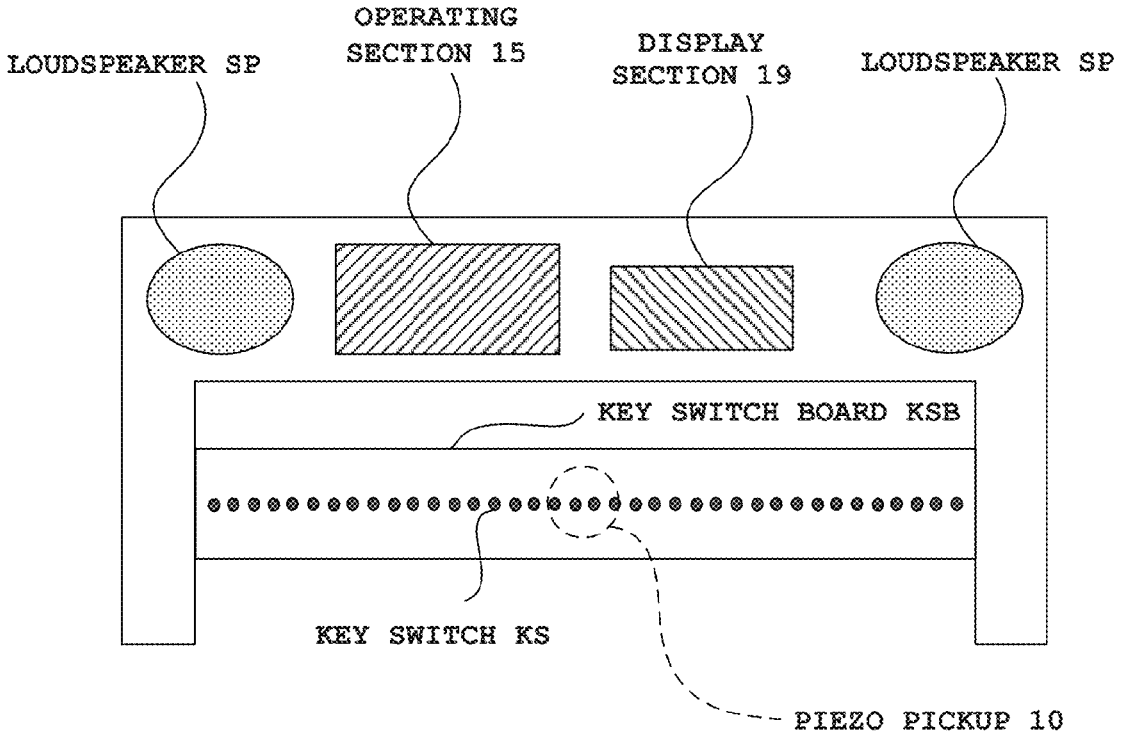
FIG. 2A and FIG. 2B are a planar view and a sectional view, respectively, for describing the arrangement position of a piezo pickup 10.
Figure 2B:
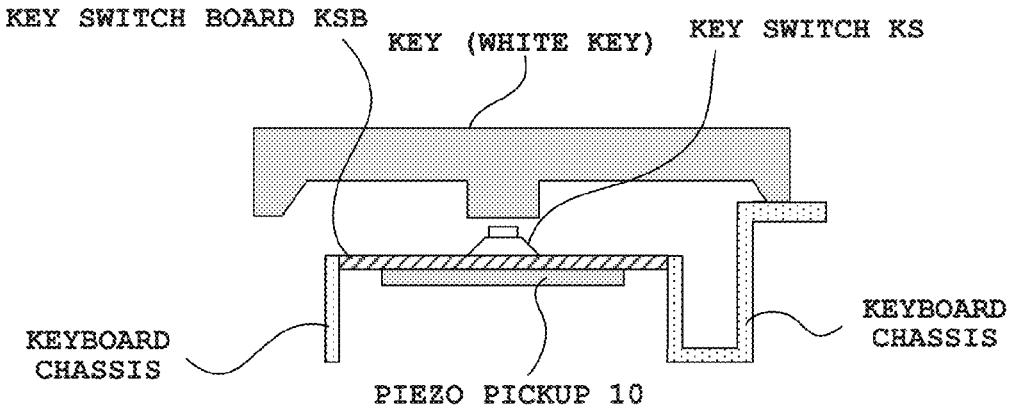

Next, a schematic structure of the keyboard 13 is described with reference to FIG. 2A and FIG. 2B. FIG. 2A and FIG. 2B are a planar view and a sectional view, respectively, for describing the arrangement position of a piezo pickup 10 (which will be described further below). On the upper surface side of a key switch board KSB fixed to and supported by a keyboard chassis, key switches KS are arranged at positions corresponding to respective keys (white keys and black keys) of the keyboard 13.

The key switches KS are each turned ON by being pressed when its key is swung downward in response to a key depression operation, and turned OFF by being released when its key is swung upward in response to a key release operation. On the lower surface side of the key switch board KSB, the piezo pickup 10 is fixedly attached to a center portion of the key switch board KSB. The piezo pickup 10, which will be described in detail further below, detects vibration that is a physical phenomenon occurring when the key switch KS is depressed by a key depression operation and enters an ON state.

B. Electrical Structure

Figure 3:
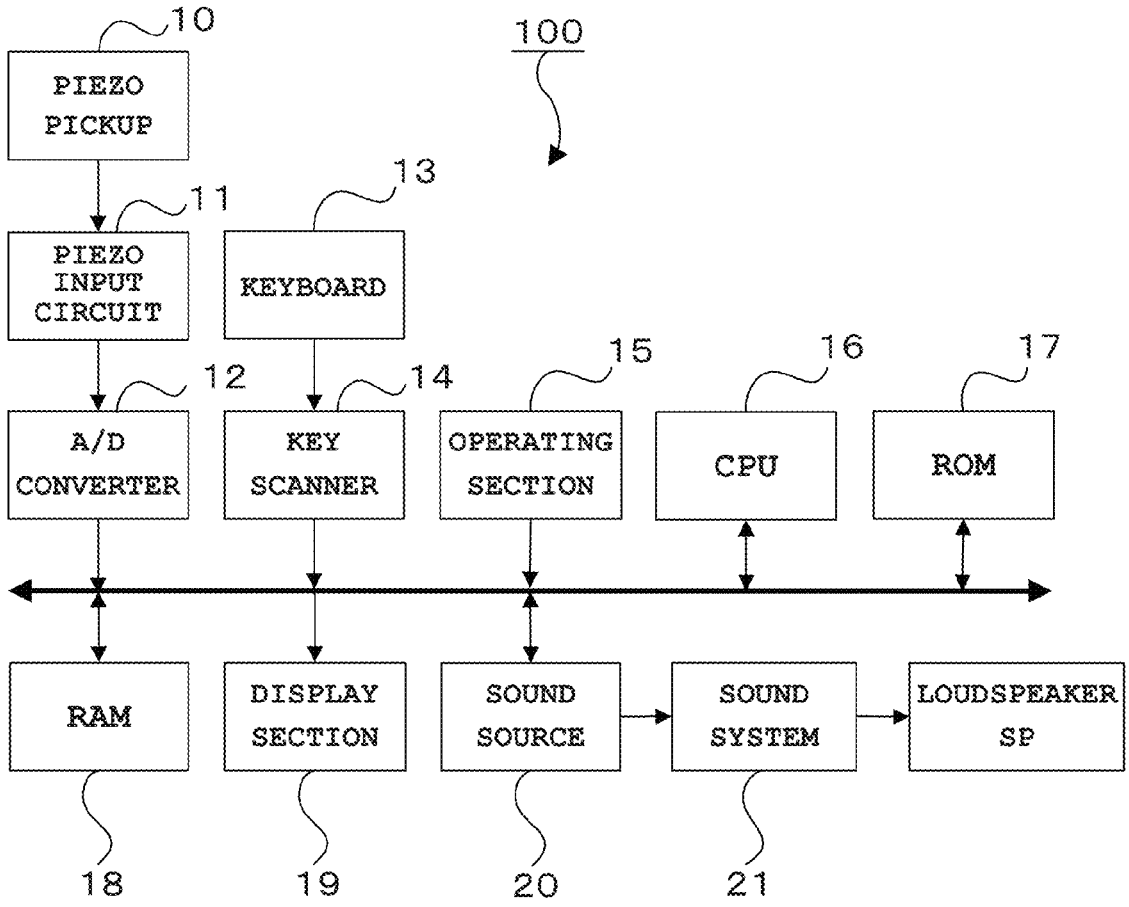
FIG. 3 is a block diagram showing the electrical structure of the electronic musical instrument 100.

Next, the electrical structure of the electronic musical instrument 100 is described with reference to FIG. 3 to FIG. 8B. FIG. 3 is a block diagram showing the structure of the electronic musical instrument 100. The piezo pickup 10 in FIG. 3 is provided by being attached to a center portion of the lower surface of the key switch board KSB as depicted in FIG. 2A and FIG. 2B, and detects a key depression vibration that occurs when the key switch KS is depressed by a key depression operation and enters an ON state, via the key switch board KSB, and thereby generates a detection output.

In the present embodiment, the piezo pickup 10 which detects key depression vibrations based on a piezoelectric effect is used. However, the present embodiment is not limited thereto. For example, a laser method may be used in which key depression vibrations are detected without contact in an area near a center portion of the lower surface of the key switch board KSB.

Figure 4:
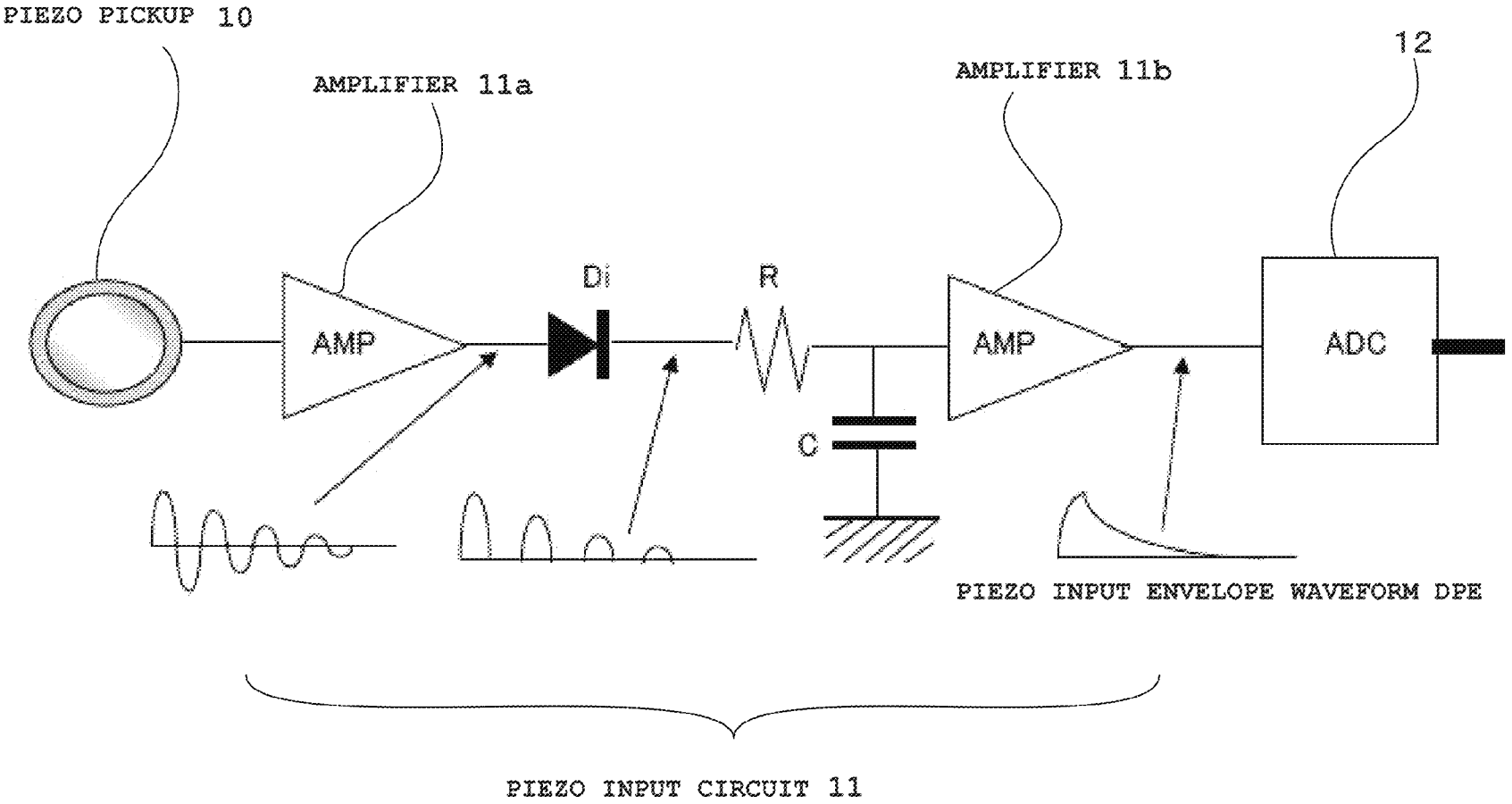
FIG. 4 is a circuit diagram showing the structure of a piezo input circuit 11.

A piezo input circuit 11 is constituted by an amplifier 11*a*, a diode Di, a resistor R, a capacitor C, and an amplifier 11*b*, as depicted in FIG. 4. The amplifier ha is a non-inverting amplifier that functions as a voltage follower, and converts an output with high impedance from the piezo pickup 10 to an output with low impedance.

The diode Di performs half-wave rectification on an output from the amplifier 11*a*. The resistor R that is in series with respect to a half-wave rectified signal outputted from the diode Di and the capacitor C that is in parallel with respect to the half-wave rectified signal form a low-pass filter, and cut high-frequency components of the half-wave rectified signal to output an envelope waveform. The amplifier 11*b* amplifies the level of an envelope waveform outputted from the low-pass filter to output a piezo input envelope waveform (refer to FIG. 4).

An A/D converter 12 in FIG. 3 performs A/D conversion on a piezo input envelope waveform signal outputted from the piezo input circuit 11 to generate piezo input envelope waveform data DPE. This piezo input envelope waveform data DPE outputted from the A/D converter 12 is temporarily stored in a work area WA of a RAM 18 under the control of a CPU 16.

The keyboard 13 and a key scanner 14 output musical performance information including a key ON/OFF signal in accordance with a musical performance operation (key-pressing/releasing operation) and the key number of a depressed key (or the key number of a released key). Note that musical performance information generated by the keyboard 13 and the key scanner 14 by a key depression operation and control data TD (which will be described further below) temporarily stored in the work area WA of the RAM 18 are converted by the CPU 16 to a note-ON event and then supplied to a sound source 20. On the other hand, musical performance information generated by the keyboard 13 and the key scanner 14 by a key release operation is converted by the CPU 16 to a note-OFF event and then supplied to the sound source 20.

Although not depicted, the operating section 15 has various switches such as a power supply switch for turning on and off a power supply and switches for setting and selecting various parameters for modifying generated musical sound, and generates a switch event corresponding to an operated switch type. The switch event generated by the operating section 15 is loaded into the CPU 16.

The CPU 16 sets the operation status of each section of the device based on various switch events supplied from the operating section 15, generates and supplies a note-ON event including musical performance information generated by the user's key depression operation and the control data TD to the sound source 20 so as to give an instruction to emit a musical sound, or generates and supplies a note-OFF event including musical performance information generated by the user's key release operation to the sound source 20 so as to give an instruction to silence a musical sound. Note that the characteristic processing operation of the CPU 16 related to the gist of the present invention will be described in detail further below. A ROM 17 in FIG. 3 stores various programs to be loaded to the CPU 16. These programs include the main routine and keyboard processing called from the main routine described below.

Figure 5:
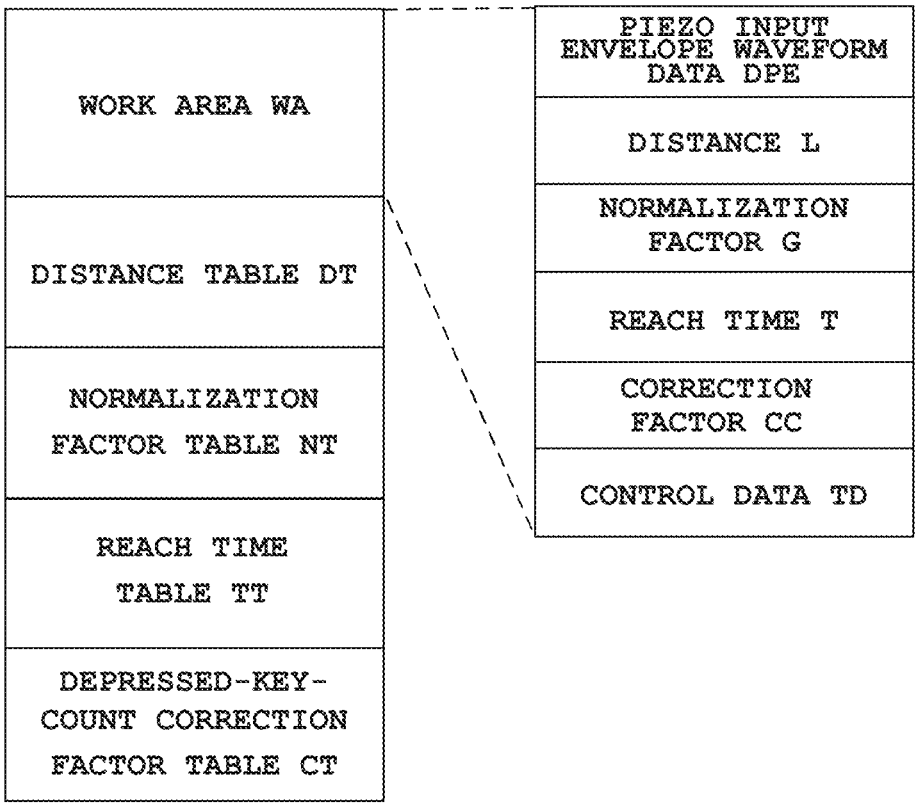
FIG. 5 is a memory map showing the data structure of a RAM 18.

The RAM 18 includes the work area WA, a distance table DT, a normalization factor table NT, a reach time table TT, and a depressed-key-count correction factor table CT, as depicted in FIG. 5. The contents of the work area WA, the distance table DT, the normalization factor table NT, the reach time table TT, and the depressed-key-count correction factor table CT are described below with reference to FIG. 5 to FIG. 8B.

The work area WA of the RAM 18 is a working area for the CPU 16, and temporarily stores various register and flag data. In this work area WA, the piezo input envelope waveform data DPE, a distance L, a normalization factor G, a reach time T, a correction factor CC, and the control data TD are temporarily stored as main data according to the present invention.

The piezo input envelope waveform data DPE is data outputted from the A/D converter 12 described above. The distance L is a distance from the center of the key switch KS of a depressed key on the keyboard 13 to the center of the piezo pickup 10. The distance L is read out from the distance table DT.

The distance table DT is a table for outputting, with the key number of a depressed key as a read address, a distance L from the key switch KS of this key number to the piezo pickup 10, as in an example depicted in FIG. 6A. For example, in a case where the keyboard 13 has thirty-four keys from key number 48 (C3 sound) to key number 81 (A5 sound), when the key of key number 49 (D3 sound) is depressed, a distance L(49) registered corresponding to the key number of the depressed key is read out from the distance table DT. Distances L(48) to L(81) registered in the distance table DT are actual measurement values or design values of distances from the center positions of the key switches KS of the respective key numbers 48 to 81 to the center position of the piezo pickup 10.

The normalization factor G is a coefficient for normalizing the amplitude level (wave height value) of the piezo input envelope waveform data DPE in accordance with the distance L. The normalization factor G is read out from the normalization factor table NT. The normalization factor table NT is a table for outputting a corresponding normalization factor G with the distance L outputted from the distance table DT as a read address, as in an example depicted in FIG. 6B. That is, the level (physical phenomenon level) of a vibration that is an output from the piezo pickup 10 is higher when a key close to the piezo pickup 10 is depressed and the level (physical phenomenon level) of a vibration is lower when a key distant from the piezo pickup 10 is depressed, even if these keys are pressed with the same strength. Accordingly, the amplitude level (wave height value) of the piezo input envelope waveform data DPE is normalized with the normalization factor G.

For example, when the distance L(49) is read out from the distance table DT, its corresponding normalization factor G(49) is read out from the normalization factor table NT. Normalization factors G(48) to G(81) registered in the normalization factor table NT have a characteristic of having a smaller value if the distance to the piezo pickup 10 is shorter and having a larger value if the distance to the piezo pickup 10 is longer, and their values are acquired as calculated values.

Figure 7:
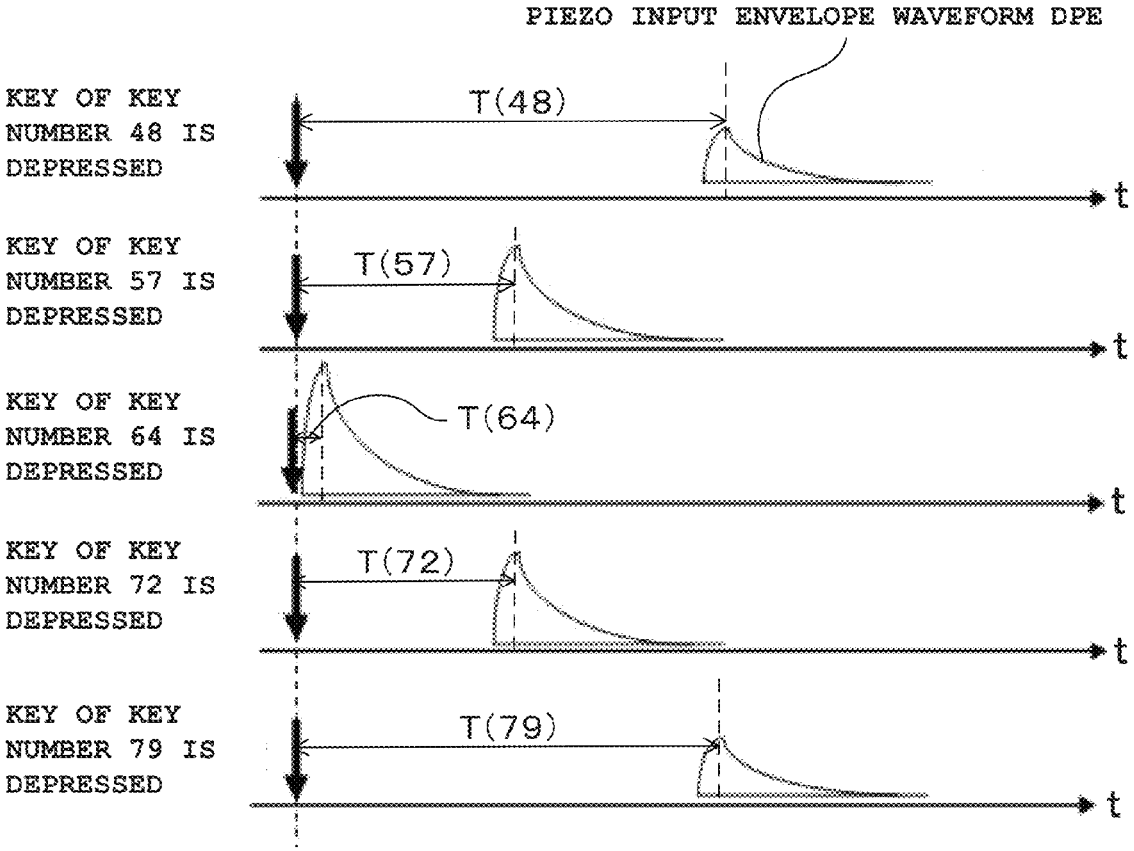
FIG. 7 is a diagram showing an example of a correlation between key numbers of depressed keys and piezo input envelope waveforms occurred by the key depression.

The reach time T is a time from when a key is depressed until when the piezo input envelope waveform data DPE generated based on an output from the piezo pickup 10 that has detected a key depression vibration occurred by the key depression operation reaches a peak level, as depicted in FIG. 7. For example, the reach time T when the key of key number 48 is depressed is T(48). This reach time T is read out from the reach time table TT.

The reach time table TT is a table for outputting the reach time T of a key depression vibration occurred by a key depression operation with the key number of the depressed key as a read address, as in an example depicted in FIG. 8A. For example, in a case where the keyboard 13 has thirty-four keys from key number 48 (C3 sound) to key number 81 (A5 sound) and the key of key number 49 (D3 sound) is depressed, a time T(49) registered corresponding to the key number of the depressed key is read out from the reach time table TT. Times T(48) to T(81) registered in the reach time table TT are actual measurement times acquired by averaging times for each of key numbers 48 to 81 acquired by measuring, on plural occasions, a time from when a key is depressed at a predetermined key depression speed until when the piezo input envelope waveform data DPE generated in accordance with the key depression vibration reaches a peak level. The time from when the key is depressed until when the piezo input envelope waveform data DPE generated in accordance with the key depression vibration reaches the peak level is short when a key close to the piezo pickup 10 is depressed, and is long when a key distant from the piezo pickup 10 is depressed.

The correction factor CC is a coefficient that is defined in accordance with the number N of keys depressed in a predetermined amount of time (for example, in 20 msec) from when the present key depression operation is performed. That is, if a plurality of keys are depressed in the predetermined amount of time from when an initial key depression operation is performed, key depression vibrations by these plurality of key depression operations are added to a key depression vibration caused by the initial depression operation, and consequently become an error, which increases the level of the piezo input envelope waveform data DPE. That is, when a plurality of keys are simultaneously depressed, an output from the piezo pickup 10 is increased as compared to a case where one key is depressed. For this reason, in order to cancel this error, the correction factor CC in accordance with the number N of keys depressed in the predetermined amount of time (for example, in 20 msec) from the present key depression operation is generated.

The correction factor CC is read out from the depressed-key-count correction factor table CT. The depressed-key-count correction table CT is a table for outputting a corresponding correction factor CC with the number N of keys depressed in the predetermined amount of time (for example, in 20 msec) from the present key depression operation as a read address, as shown in an example depicted in FIG. 8B. For example, when the number of depressed keys is "1", a correction factor CC(1) is read out, which has a value of "1". Also, when the number of depressed keys is "2", a correction factor CC(2) is read out, which has a value smaller than "1". That is, the correction factors CC(1) to CC(N) registered in the depressed-key-count correction factor table CT have a smaller value as the number of depressed keys is increased, and its value is acquired as an experimental value.

The electrical structure of the embodiment is further described with reference to FIG. 3 again. The display section 19 in FIG. 3 displays the setting status and the operation status of each section of the musical instrument based on a display control signal supplied from the CPU 16. The sound source 20 includes a plurality of sound-emission channels (MIDI channels) formed by a known waveform memory read method, and generates musical sound waveform data W in accordance with a note-ON/note-OFF event supplied from the CPU 16. A sound system 21 in FIG. 3 converts the musical sound waveform data W outputted from the sound source 20 to an analog musical sound signal, performs filtering such as removing unwanted noise from the musical sound signal, amplifies the resultant signal, and emits the sound from the loudspeakers SP.

C. Operation

Next, each operation of the main routine and keyboard processing to be performed by the CPU 16 of the above-described electronic musical instrument 100 is described with reference to FIG. 9 and FIG. 10. Note that, in the following descriptions, the CPU 16 is a subject of operations unless otherwise specified.

(1) Operation of Main Routine

Figure 9:
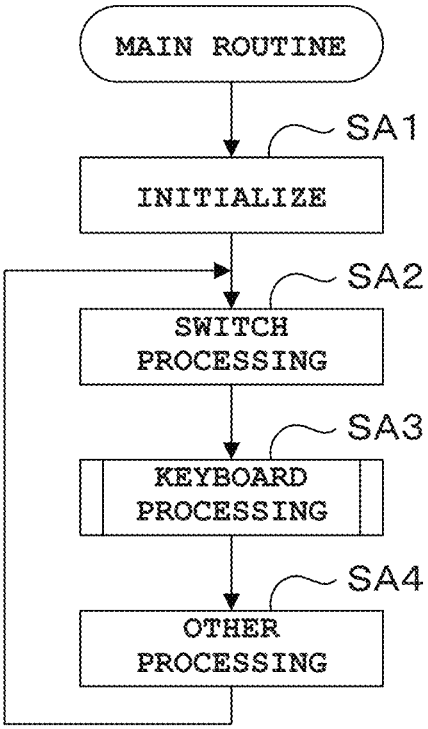
FIG. 9 is a flowchart of operations in the main routine in the first embodiment.

FIG. 9 is a flowchart of operations in the main routine. When a power supply is turned ON, the CPU 16 starts this routine, proceeds to Step SA1 depicted in FIG. 9, and performs initialization processing for initializing each section of the musical instrument. Then, when the initialization processing is completed, the CPU 16 proceeds to Step SA2, and performs switch processing based on a switch event generated corresponding to the type of a switch operated by the user using the operating section 15. For example, the CPU 16 specifies the tone color of a musical sound to be emitted, in response to the operation of a tone-color selection switch, or specifies the type of effects to be added to a musical sound to be emitted, in response to the operation of operation of an effect selection switch.

Then, when the switch processing at Step SA2 is completed, the CPU 16 performs keyboard processing at Step SA3. In the keyboard processing, as will be described further below, the CPU 16 acquires the key number KN of a depressed key, and starts the counting of the number N of keys depressed in the predetermined amount of time (for example, 20 msec) with the present key depression operation as a starting point. Subsequently, the CPU 16 acquires a distance L(KN) which is a distance from the center of the key switch KS of the acquired key number KN to the center of the piezo pickup 10, a normalization factor G(KN) corresponding to the distance L(KN), a reach time T(KN) corresponding to the key number KN, and a correction factor CC(N) corresponding to the number N of depressed keys.

Subsequently, the CPU 16 calculates control data TD by multiplying piezo input envelope waveform data DPE acquired when the reach time T(KN) has elapsed by the normalization factor G(KN) and the correction factor CC(N) (DPE×G(KN)×CC(N)) generates a note-ON event including the control data TD and the key number KN, and sends it to the sound source 20. As a result, the sound source 20 emits a musical sound at a pitch corresponding to the key number KN included in the note-ON event, and performs a touch control of controlling the sound volume and the tone color of the emitted musical sound in accordance with the control data TD included in the note-ON event.

Then, at Step SA4, the CPU 16 performs other processing such as processing for displaying the setting status and the operation status of each section of the musical instrument on the screen of the display section 19, and then returns to the above-described Step SA2. Thereafter, the CPU 16 repeatedly performs Steps SA2 to SA4 described above until the electronic musical instrument 100 is turned off.

(2) Operation of Keyboard Processing

Next, the operation of the keyboard processing is described with reference to FIG. 10. FIG. 10 is a flowchart of operations in the keyboard processing. When the keyboard processing is started at Step SA3 (refer to FIG. 9) of the main routine, the CPU 16 proceeds to Step SB1 depicted in FIG. 10, and performs key scanning for detecting a key change for each key of the keyboard 13. The key change herein refers to the presence or absence of a key-ON event by a key depression operation or a key-OFF event by a key release operation. Subsequently, at Step SB2, the CPU 16 determines the presence or absence of a key change based on the key scanning result at Step SB1.

When a key depression/release operation has not been performed and a key change has not occurred, the CPU 16 ends the processing. Conversely, when a key depression operation is detected, the CPU 16 performs Steps SB3 to SB11 described below. When a key release operation is detected, the CPU 16 performs Step SB12 described below. Hereafter, operations that are performed "when a key depression operation is detected" and operations that are performed "when a key release operation is detected" are described separately.

a. Operations when Key Depression is Detected

When a key-ON event by a key depression operation is detected, the CPU 16 proceeds to Step SB3 via Step SB2 described above, and acquires the key number KN of the depressed key. Here, if a plurality of keys have been depressed, the CPU 16 acquires the key number KN of a key depressed first, by following a known first-come first-served rule. Subsequently, at Step SB4, the CPU 16 gives an instruction to perform depressed-key count processing. This depressed-key count processing is processing for counting the number N of keys depressed in the predetermined amount of time (for example, 20 msec) with the present key depression operation as a starting point, which is achieved by known timer interruption.

Next at Step SB5, the CPU 16 acquires the distance L(KN) corresponding to the key number KN from the above-described distance table DT (refer to FIG. 6A). The distance L(KN) is a distance from the center of the key switch KS of this key number KN to the center of the piezo pickup 10.

Subsequently, at Step SB6, the CPU 16 acquires the normalization factor G(KN) corresponding to the distance L(KN) from the above-described normalization factor table NT (refer to FIG. 6B). The normalization factor G(KN) is a coefficient that is used in the normalization of the amplitude level (wave height value) of the piezo input envelope waveform data DPE in accordance with the distance L(KN). The normalization factor G(KN) has a characteristic of having a smaller value when the distance L(KN), which is a distance from the center of the key switch KS of the key number KN to the center of the piezo pickup 10, is short, and having a larger value when the distance L(KN) is long.

Next at Step SB7, the CPU 16 acquires the reach time T(KN) corresponding to the key number KN from the above-described reach time table TT (refer to FIG. 8A). The reach time T(KN) is a time from when a key is depressed until when the piezo input envelope waveform data DPE generated based on an output from the piezo pickup 10 that has detected a key depression vibration occurred by the key depression operation reaches a peak level.

Then, the CPU 16 proceeds to Step SB8, and acquires the correction factor CC(N) corresponding to the number N of depressed keys from the depressed-key-count correction factor table CT described above (refer to FIG. 8B). Note that the number N of depressed keys is counted by the depressed-key count processing started at Step SB4 described above. The correction factor CC(N) is an experimental value that has a smaller value as the number N of depressed keys is increased. Next, at Step SB9, the CPU 16 waits until the reach time T(KN) acquired at Step SB7 elapses. Subsequently, at Step SB10, the CPU 16 acquires the piezo input envelope waveform data DPE when the reach time T(KN) has elapsed.

Then, at Step SB11, the CPU 16 calculates control data TD by multiplying the piezo input envelope waveform data DPE acquired at Step SB10 by the normalization factor G(KN) acquired at Step SB6 and the correction factor CC(N) acquired at Step SB8 (DPE×G(KN)×CC(N)), generates a note-ON event including the calculated control data TD and the key number KN, sends it to the sound source 20, and ends the processing.

As a result, the sound source 20 emits a musical sound at a pitch corresponding to the key number KN included in the note-ON event, and performs a touch control of controlling the sound volume and the tone color of the emitted musical sound in accordance with the control data TD included in the note-ON event.

b. Operations when Key Releasing is Detected

When a key-OFF event occurs in response to a key release operation, the CPU 16 proceeds to Step SB12 via Step SB2 described above. At Step SB12, the CPU 16 generates a note-OFF event including the key number KN of a released key, sends it to the sound source 20, and ends the processing. As a result, the sound source 20 silences the musical sound at the pitch corresponding to the key number KN of the released key from among musical sounds being emitted.

As described above, in the keyboard processing, when a key-ON event occurs in response to a key depression operation, the CPU 16 acquires the key number KN of the depressed key, and starts the counting of the number of keys depressed in the predetermined amount of time (for example, 20 msec) with the present key depression operation as a starting point. Subsequently, the CPU 16 acquires the distance L(KN) which is a distance from the center of the key switch KS of the acquired key number KN to the center of the piezo pickup 10, the normalization factor G(KN) corresponding to the distance L(KN), the reach time T(KN) corresponding to the key number KN, and the correction factor CC(N) corresponding to the number N of pressed keys.

Then, the CPU 16 calculates the control data TD by multiplying the piezo input envelope waveform data APE acquired when the reach time T(KN) has elapsed by the normalization factor G(KN) and the correction factor CC(N) (DPE×G(KN)×CC(N)), generates a note-ON event including the control data TA and the key number KN, and sends it to the sound source 20. As a result, the sound source 20 emits a musical sound at a pitch corresponding to the key number KN included in the note-ON event, and performs touch control of controlling the sound volume and the tone color of the emitted musical sound in accordance with the control data TA included in the note-ON event.

As described above, in the first embodiment, the piezo pickup 10 for detecting a key depression vibration occurred by a key depression operation is provided on the center portion of the lower surface of the key switch board KSB where the key switches KS for the keys (white keys and black keys) of the keyboard 13 are arranged. In this embodiment, the key number KN of a depressed key and the distance L between the key switch KS of the key number KN and the piezo pickup 10 are acquired in response to a key depression operation. Then, based on control data TD acquired by correcting the detection output level (piezo input envelope waveform) of the piezo pickup 10 in accordance with the acquired distance L, the sound volume of a musical sound at a pitch corresponding to the key number KN and the filter coefficient (level) are changed to change the musical sound waveform, whereby the tone color is controlled.

Therefore, unlike the related art, neither a pressure-sensitive sensor arranged for each key of a keyboard nor processing for uniformly adjusting the sensitivity of each pressure-sensitive sensor provided for each key is required. As a result, touch control can be actualized without an increase in manufacturing cost.

Also, in the first embodiment, the detection output level (piezo input envelope waveform) of the piezo pickup 10 is normalized in accordance with the distance L between the key switch KS of the key number KN and the piezo pickup 10. Therefore, sensitivity for detecting key depression vibrations can be equalized.

Moreover, in the first embodiment, the number N of keys depressed in the predetermined amount of time (for example, 20 msec) is counted with the present key depression operation as a starting point, and the detection output level (piezo input envelope waveform) of the piezo pickup 10 is corrected by following the correction factor CC based on the counted number N of keys. Therefore, an error due to key depression vibrations by the depression of a plurality of keys with respect to a key depression vibration by the present key depression operation can be cancelled.

D. Modification Example

Figure 11:
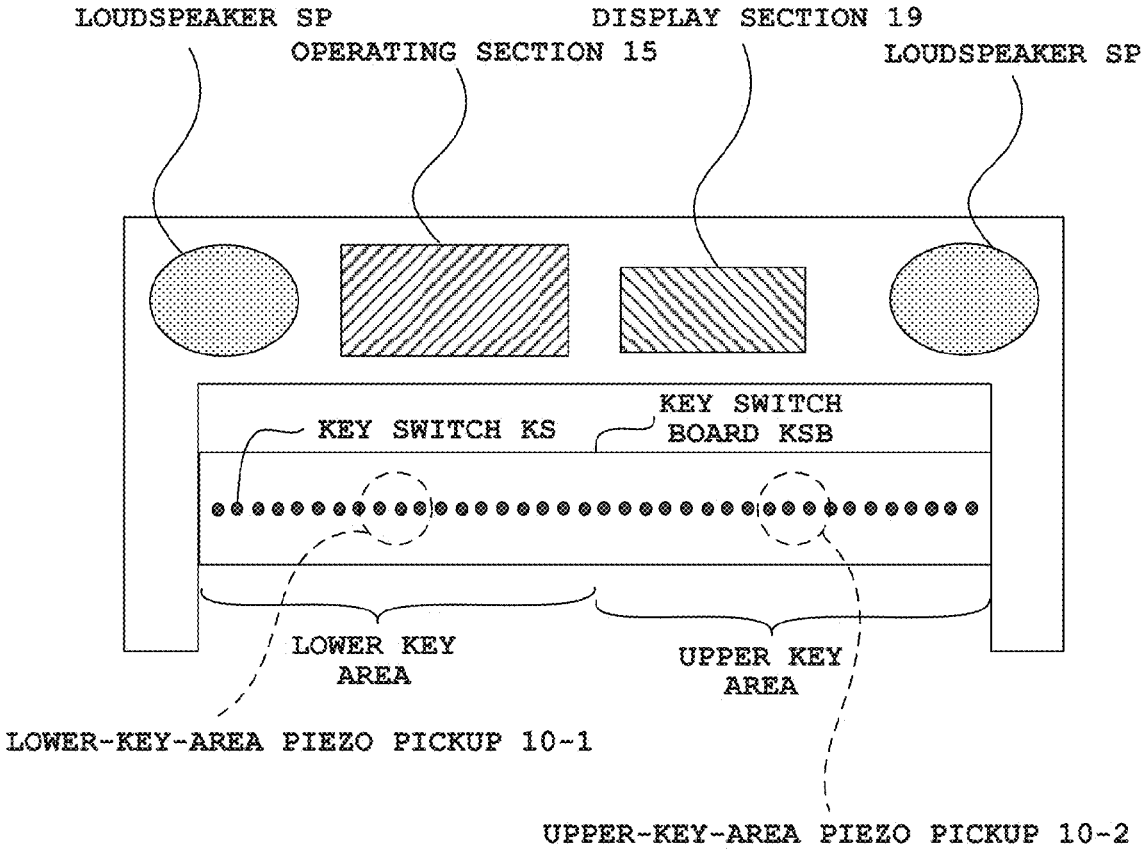
FIG. 11 is a planar view for describing the arrangement position of the piezo pickup 10 in a modification example.

Next, a modification example of the first embodiment is described with reference to FIG. 11. FIG. 11 is a planar and sectional view for describing the arrangement position of the piezo pickup 10 in the modification example. Note that components in FIG. 11 which are equivalent to those of the first embodiment in FIG. 2 are provided with the same reference numerals and descriptions therefor are omitted.

The modification example depicted in FIG. 11 is different from the first embodiment depicted in FIG. 2 in that the key switches KS arranged on the key switch board KSB are divided into those in a lower key area and those in an upper key area, and a lower-key-area piezo pickup 10-1 associated with each key switch KS on the lower key area side and an upper-key-area piezo pickup 10-2 associated with each key switch KS on the upper-key-area side are provided.

By the keyboard 13 being divided into the lower key area and the upper key area and the piezo pickups 10-1 and 10-2 being provided to the respective key areas, a distance between the key switch KS of a depressed key and the piezo pickup 10-1 (or 10-2) is shortened. As a result, key depression vibration levels to be detected by each of the piezo pickups 10-1 and 10-2 can be improved.

In the above-described modification example, the keyboard processing of the first embodiment described above (refer to FIG. 12) is divided into first keyboard processing for detecting a key change by key scanning in the lower key area and second keyboard processing for detecting a key change by key scanning in the upper key area, and performed time-divisionally.

Second Embodiment

A. Outer Appearance and Schematic Structure

Figure 12:
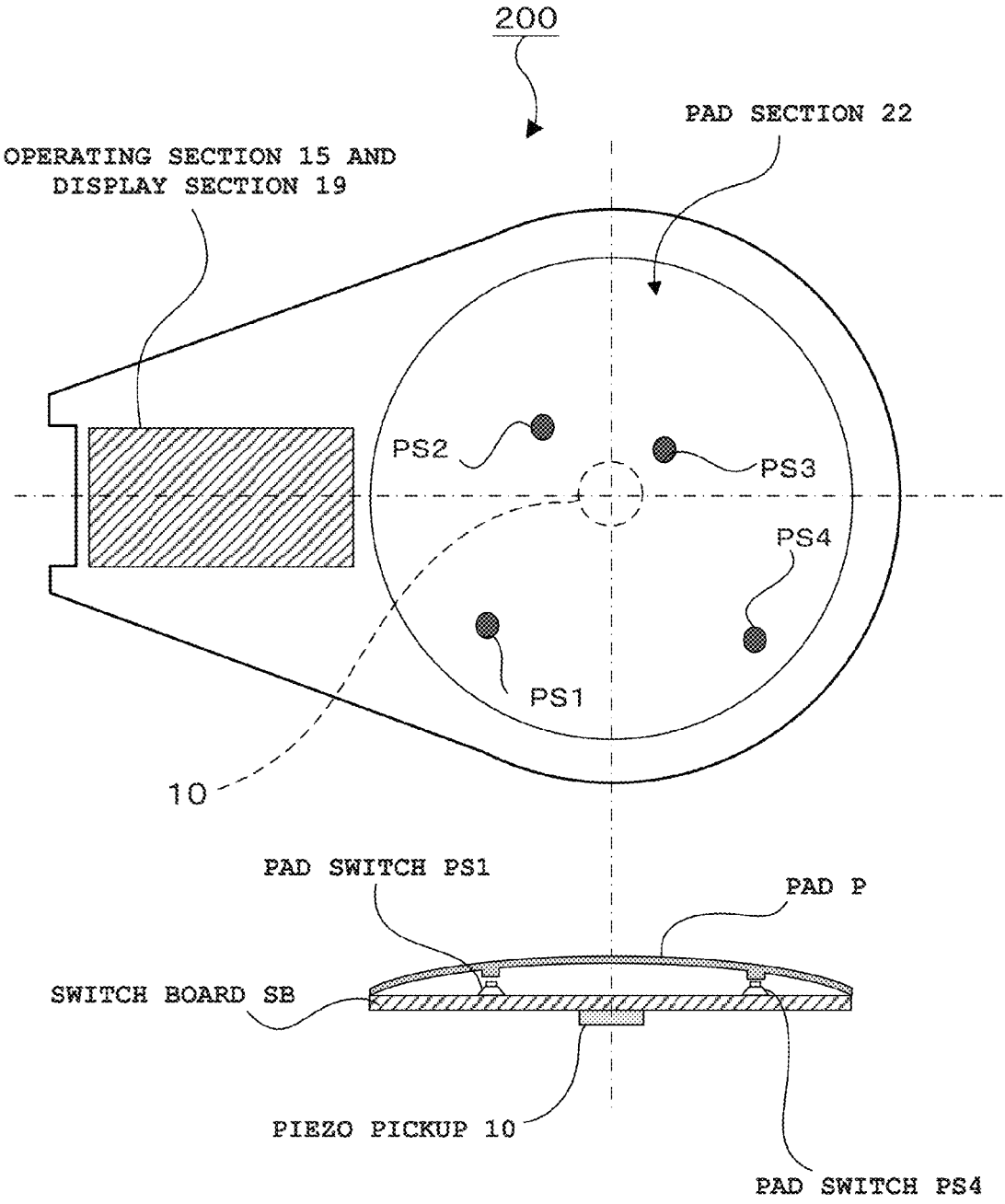
FIG. 12 is a diagram showing the outer appearance and the schematic structure of an electronic percussion instrument 200 according to a second embodiment.

FIG. 12 is a diagram showing the outer appearance and the schematic structure of an electronic percussion instrument 200 including a musical sound control device according to a second embodiment of the present invention. Note that components in FIG. 12 which are equivalent to those of the first embodiment in FIG. 1 are provided with the same reference numerals and descriptions therefor are omitted.

The electronic percussion instrument 200 depicted in FIG. 12, which has a housing having a substantially teardrop shape when viewed from top, includes a pad section 22 provided on its circular portion and the operating section 15 and the display section 19 provided on its tail portion. The pad section 22 is constituted by pad switches PS1 to PS4 and a dome-shaped pad P formed to cover these pad switches PS1 to PS4.

When portions of the pad P corresponding to the pad switches PS1 to PS4 are operated, the pad switches PS1 to PS4 enter ON states, respectively, and musical sounds corresponding to the portions of the pad P corresponding to the pad switches PS1 to PS4 are emitted, respectively. That is, the portions of the pad P corresponding to the pad switches PS1 to PS4 are operated as operators.

The pad switches PS1 to PS4 are arranged on the upper surface of a switch board SB fixed to and supported by the housing, and positioned differently to be away from the center of the piezo pickup 10 by a distance L(PS1), a distance L(PS2) a distance L(PS3), and a distance L(PS4), respectively. The pad P is formed by resin such that it has projecting portions in areas opposing the pad switches PS1 to PS4, and structured such that one of the pad switches PS1 to PS4 opposing the projecting portions are pressed in accordance with a point subjected to a pad operation (of striking a pad).

The piezo pickup 10 is fixedly attached to a center portion of the lower surface of the switch substrate SB where the pad switches PS1 to PS4 are arranged. This piezo pickup 10 detects, via the switch substrate SB, a striking vibration that occurs when one of the pad switches PS1 to PS4 is pressed to enter an ON state by a pad operation on the pad P.

B. Electrical Structure

Figure 13:
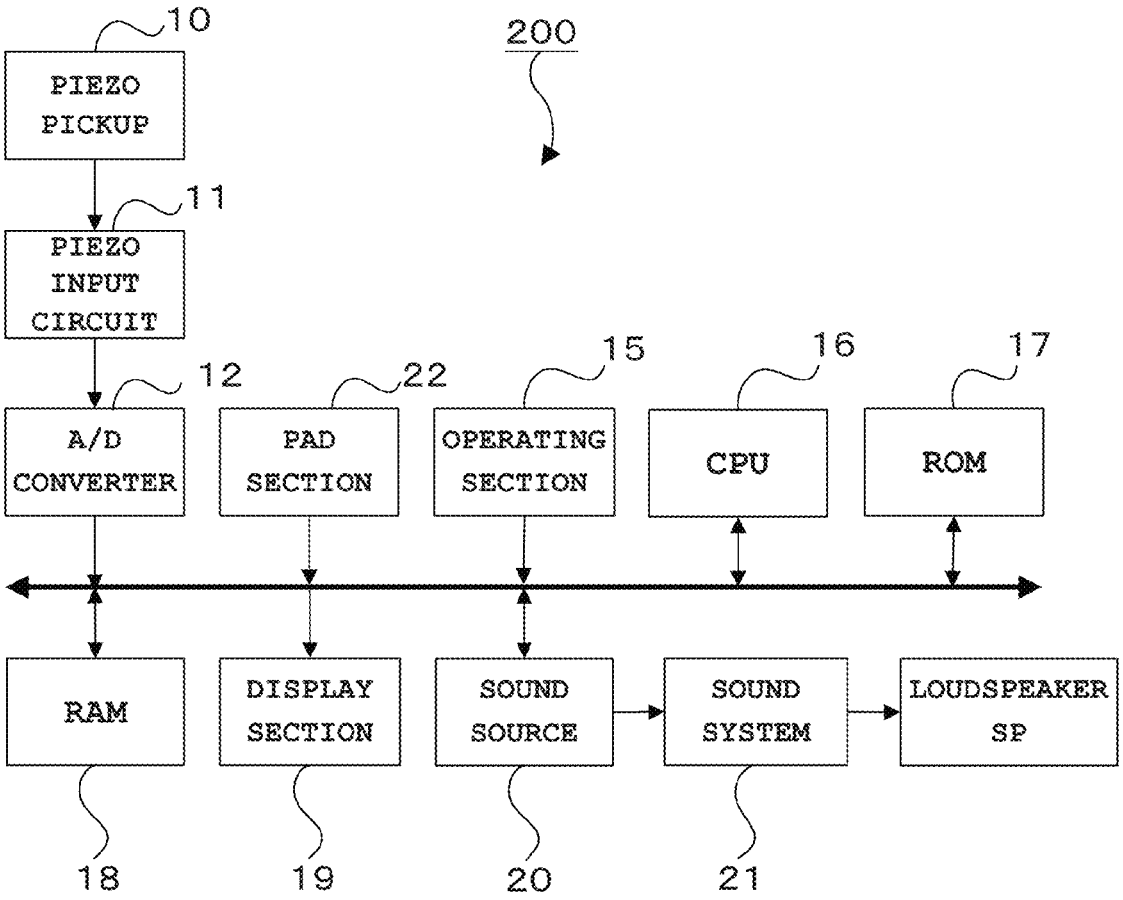
FIG. 13 is a block diagram showing the electronic structure of the electronic percussion instrument 200.

Next, the electrical structure of the electronic percussion instrument 200 is described with reference to FIG. 13 to FIG. 16. FIG. 13 is a block diagram showing the structure of the second embodiment (electronic percussion instrument 200). Note that components in FIG. 13 which are equivalent to those of the above-described first embodiment (electronic musical instrument 100) are provided with the same reference numerals and descriptions therefor are omitted.

The electronic percussion instrument 200 depicted in FIG. 13 is different from the electronic musical instrument 100 of the first embodiment depicted in FIG. 3 in that the above-described pad section 22 is provided in place of the keyboard 13, and the key scanner 14 and the piezo pickup 10 detects a striking vibration that occurs when one of the pad switches PS1 to PS4 is pressed to enter an ON state by a pad operation on the pad P.

Figure 14:
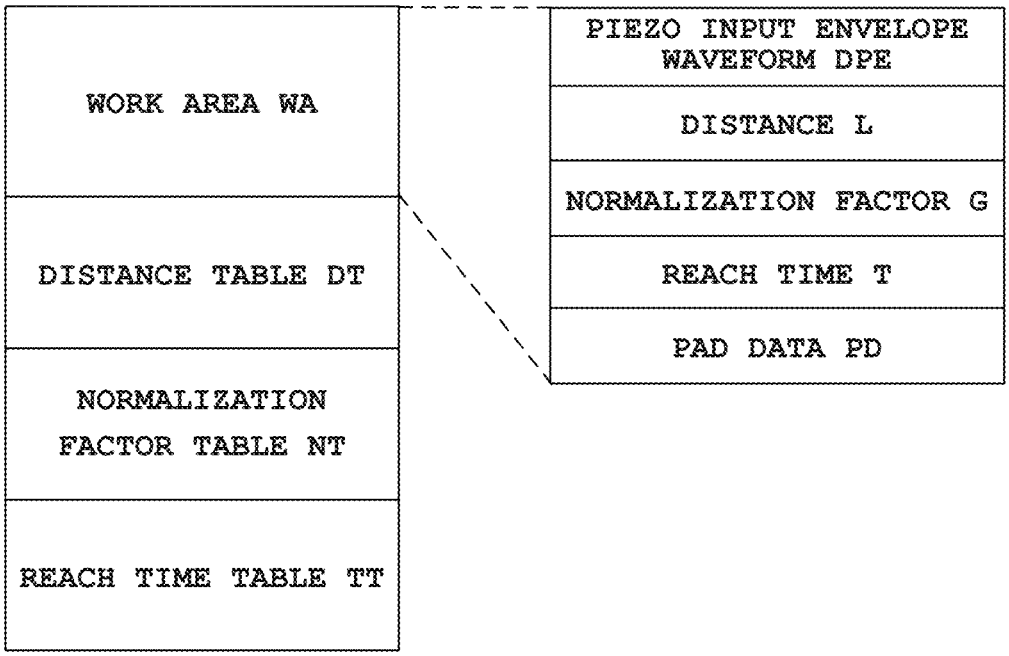
FIG. 14 is a memory map showing the data structure of a RAM 18 according to the second embodiment.

In the following descriptions, as a difference from the first embodiment, the data structure of the RAM 18 in the second embodiment is described. The RAM 18 includes the work area WA, the distance table DT, the normalization factor table NT, and the reach time table TT, as depicted in FIG. 14. The work area WA of the RAM 18 is a working area for the CPU 16, and temporarily stores various register and flag data. In this work area WA, the piezo input envelope waveform data DPE, the distance L, the normalization factor G, the reach time T, and pad data PD are temporarily stored as main data according to the present invention.

The piezo input envelope waveform data DPE is data outputted from the A/D converter 12 described above. The distance L is a distance from the center of a pressed pad switch on the pad section 22 to the center of the piezo pickup 10, which is read out from the distance table DT.

The distance table DT is a table for outputting, with the number PN (any of PS1 to PS4) of a pressed pad switch as a read address, a distance L(PN) from the pad switch to the piezo pickup 10, as in an example depicted in FIG. 15A. For example, when the pad switch PS1 is pressed in response to a pad operation, a distance L (PS1) registered corresponding thereto is read out from the distance table DT. Distances L(PS1) to L(PS4) registered in the distance table DT are measurement values or design values of distances from the center of the respective pad switches PS1 to PS4 to the center of the piezo pickup 10.

The normalization factor G is a coefficient for normalizing the amplitude level (wave height value) of the piezo input envelope waveform data DPE in accordance with the distance L. The normalization factor G is read out from the normalization factor table NT. The normalization factor table NT is a table for outputting a corresponding normalization factor G with the distance L outputted from the distance table DT as a read address, as in an example depicted in FIG. 15B.

For example, when the distance L (PS2) is read out from the distance table DT, its corresponding normalization factor G(PS2) is read out from the normalization factor table NT. Normalization factors G(PS1) to G(PS4) registered in the normalization factor table NT have a characteristic of having a smaller value if the distance to the piezo pickup 10 is shorter and having a larger value if the distance to the piezo pickup 10 is longer, and their values are acquired as calculated values.

The reach time T is a time from when the pad switch PS is pressed in response to a pad operation (of striking the pad P) until when the piezo input envelope waveform data DPE generated based on an output from the piezo pickup 10 that has detected a striking vibration occurred by the pad operation reaches a peak level, and is read out from the reach time table TT.

The reach time table TT is a table for outputting the reach time T of a striking vibration with the pad switch number (PS1 to PS4) of a pressed pad switch as a read address, as in an example depicted in FIG. 16. For example, when the pad switch PS3 is pressed in response to a pad operation, a reach time T(PS3) registered corresponding thereto is read out from the distance table DT. Reach times T(PS1) to T(PS4) registered in the reach time table TT are actual measurement times acquired by averaging times for each of the pad switches PS1 to PS4 acquired by measuring, on plural occasions, a time from when a pad switch is pressed at a predetermined speed to enter an ON state until when the piezo input envelope waveform data DPE generated in accordance with the striking vibration reaches a peak level.

C. Operation

Next, operations in the main routine to be performed by the CPU 16 of the electronic percussion instrument 200 of the second embodiment and pad processing are described with reference to FIG. 17 and FIG. 18. Note that, in the following descriptions, the CPU 16 is a subject of operations unless otherwise specified.

(1) Operation of Main Routine

Figure 17:
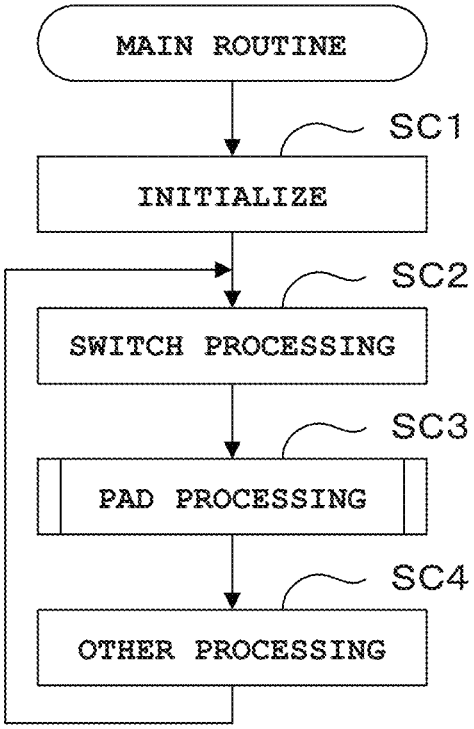
FIG. 17 is a flowchart of operations in the main routine according to the second embodiment.
Figure 18:
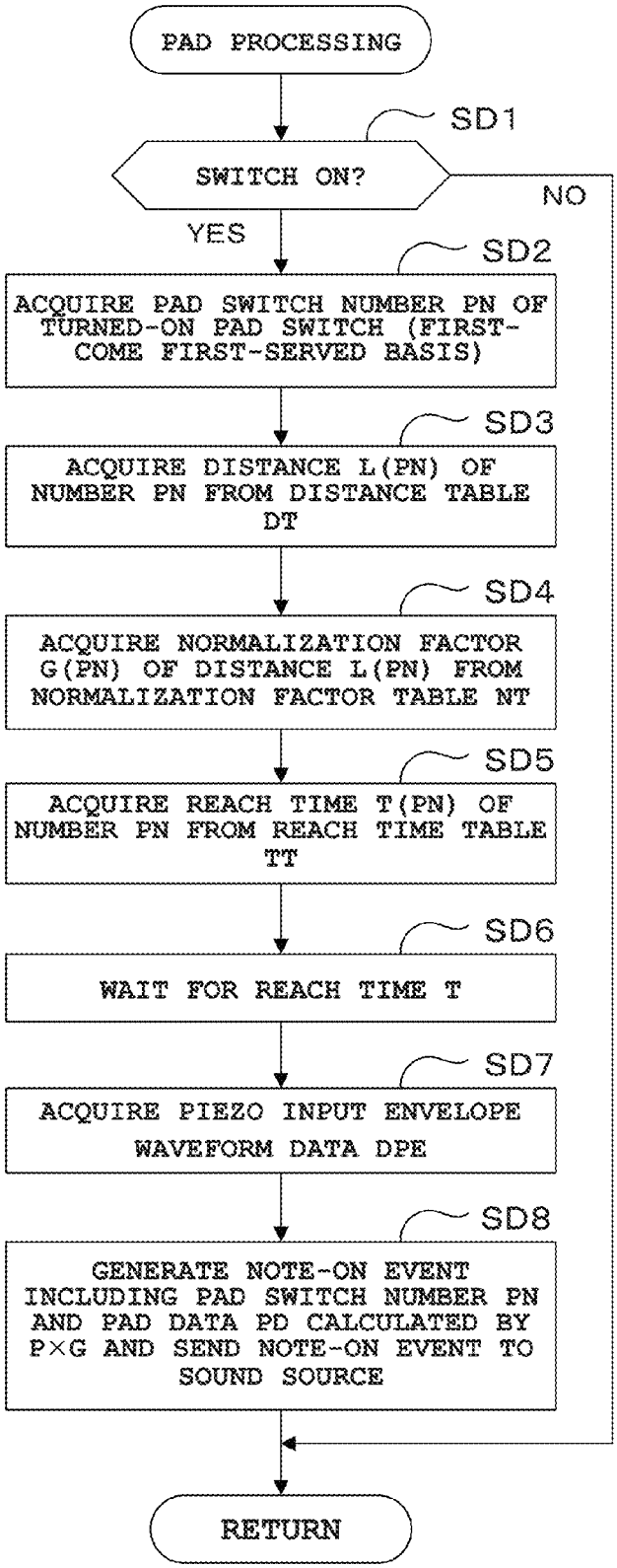
FIG. 18 is a flowchart of operations in pad processing according to the second embodiment.

FIG. 17 is a flowchart of operations in the main routine. When a power supply is turned ON, the CPU 16 starts this routine, proceeds to Step SC1 depicted in FIG. 17, and performs initialization processing for initializing each section of the musical instrument. Then, when the initialization processing is completed, the CPU 16 proceeds to Step SC2, and performs switch processing based on a switch event generated corresponding to the type of a switch operated by the user using the operating section 15. For example, the CPU 16 specifies the tone color of percussion sound to be emitted, in response to the operation of a tone-color selection switch, or specifies the type of effects to be added to a percussion sound to be emitted, in response to the operation of an effect selection switch.

Then, at Step SC3, the CPU 16 performs pad processing. In the pad processing, when one of the pad switches PS1 to PS4 is pressed in response to a pad operation of striking the pad P and enters an ON state, the CPU 16 acquires the number PN of the pad switch in the ON state, and then acquires a distance L(PN), which is a distance from the center of the pad switch of the acquired number PN to the center of the piezo pickup 10, a normalization factor G(PN) corresponding to the distance L(PN), and a reach time T(PN) corresponding to the number PN of the pad switch, as will be described further below.

Subsequently, the CPU 16 calculates pad data PD by multiplying piezo input envelope waveform data DPE acquired when the reach time T(PN) has elapsed by the normalization factor G(PN) (DPE×G(PN)), generates a note-ON event including the pad data PD and the number PN of the pad switch, and sends it to the sound source 20. As a result, the sound source 20 emits a percussion sound of a type assigned to the number PN of the pad switch included in the note-ON event, and performs a touch control of controlling the sound volume and the tone color of the percussion sound in accordance the pad data PD included in the note-ON event.

Then, at Step SC4, the CPU 16 performs other processing such as processing for displaying the setting status and the operation status of each section of the musical instrument on the screen of the display section 19, and then returns to the above-described Step SC2. Thereafter, the CPU 16 repeatedly performs Steps SC2 to SC4 described above until the electronic percussion instrument 200 is turned off.

(2) Operation of Pad Processing

Next, the operation of the pad processing is described with reference to FIG. 18. FIG. 18 is a flowchart of operations in the pad processing. When the pad processing is started at Step SC3 (refer to FIG. 17) of the main routine, the CPU 16 proceeds to Step SD1 depicted in FIG. 18, and judges whether any one of the pad switches PS1 to PS4 of the pad section 22 has entered an ON state.

When judged that all of them are in an OFF state, the judgment result is "NO", and therefore the CPU 16 completes the processing. When judged that one of them has entered an ON state in response to the user's pad operation, the judgment result at Step SD1 is "YES", and therefore the CPU 16 proceeds to Step SD2. At Step SD2, the CPU 16 acquires the number PN of the pad switch that has entered the ON state. Here, if a plurality of pad switches are in an ON state, the number PN (any of PS1 to PS4) of a pad switch that has entered an ON state first is acquired, by following a known first-come first-served rule.

Subsequently, at Step SD3, the CPU 16 acquires the distance L(PN) corresponding to the number PN of the pad switch that has entered the ON state from the above-described distance table DT (refer to FIG. 15A). The distance L(PN) is a distance from the center of the pad switch of this number PN to the center of the piezo pickup 10.

Next, at Step SD4, the CPU 16 acquires the normalization factor G(PN) corresponding to the distance L(PN) from the above-described normalization factor table NT (refer to FIG. 15B). The normalization factor G(PN) is a coefficient that is used in the normalization of the amplitude level (wave height value) of the piezo input envelope waveform data DPE in accordance with the distance L (PN). The normalization factor G(PN) has a characteristic of having a smaller value when the distance L (PN), which is a distance from the center of the pad switch of the number PN to the center of the piezo pickup 10, is short, and having a larger value when the distance L(PN) is long.

Next at Step SD5, the CPU 16 acquires the reach time T(PN) corresponding to the number PN of the pad switch in the ON state from the above-described reach time table TT (refer to FIG. 16). The reach time T(PN) is a time from when a pad switch enters an ON state until when the piezo input envelope waveform data DPE generated in response to a striking vibration reaches a peak level. Then, the CPU 16 proceeds to Step SD6, and waits until the reach time T(PN) acquired at Step SD5 elapses. Subsequently, at Step SD7, the CPU 16 acquires the piezo input envelope waveform data DPE when the reach time T(PN) has elapsed.

Then, at Step SD8, the CPU 16 calculates pad data PD by multiplying the piezo input envelope waveform data DPE acquired at Step SD7 by the normalization factor G(PN) acquired at Step SD4 (DPE×G(PN)) generates a note-ON event including the calculated pad data PD and the number PN of the pad switch, sends it to the sound source 20, and ends the processing.

As a result, the sound source 20 emits a percussion sound of a type assigned to the number PN of the pad switch included in the note-ON event, and performs a touch control of controlling the sound volume and the tone color of the percussion instrument in accordance with the pad data PD included in the note-ON event.

As described above, in the pad processing, when one of the pad switches PS1 to PS4 is pressed and enters an ON state in response to a pad operation of striking the pad P, the CPU 16 acquires the number PN of the pad switch that has entered the ON state, and acquires the distance 1, (PN) that is a distance from the center of the pad switch of the acquired number PN to the center of the piezo pickup 10, the normalization factor G(PN) corresponding to the distance L (PN), and the reach time T(PN) corresponding to the number PN of the pad switch.

Then, the CPU 16 calculates pad data PD by multiplying piezo input envelope waveform data DPE acquired when the reach time T(PN) has elapsed by the normalization factor G(PN) (DPE×G(PN)), generates a note-ON event including the pad data PD and the number PN of the pad switch, and sends it to the sound source 20. As a result, the sound source 20 emits a percussion sound of a type assigned to the number PN of the pad switch included in the note-ON event, and performs a touch control of controlling the sound volume and the tone color of the percussion sound in accordance with the pad data PD included in the note-ON event.

As described above, in the second embodiment, the piezo pickup 10 for detecting a striking vibration occurred by a pad operation of striking the pad P is provided on the center portion of the lower surface of the switch board SB where the pad switches PS1 to PS4 which enter an ON state when pressed in response to a pad operation are arranged. In this embodiment the number PN of a pad switch that has entered an ON state by a pad operation and the distance L(PN) between the pad switch of this number PN and the piezo pickup 10 are acquired. Then, based on pad data PD acquired by correcting the detection output level (piezo input envelope waveform) of the piezo pickup 10 in accordance with the acquired distance L(PN), the sound volume of a percussion sound of a type assigned to the number PN of the pad switch and the filter coefficient are changed to change the musical sound waveform, whereby the tone color is controlled.

Therefore, unlike the related art, neither a pressure-sensitive sensor arranged for each pad switch nor processing for uniformly adjusting the sensitivity of each pressure-sensitive sensor provided for each pad switch is required. As a result, touch control can be actualized without an increase in manufacturing cost.

Also, in the second embodiment, the detection output level (piezo input envelope waveform) of the piezo pickup 10 is normalized in accordance with the distance L between the pad switch of the number PN and the piezo pickup 10. Therefore, sensitivity for detect striking vibrations can be equalized.

Figure 19:
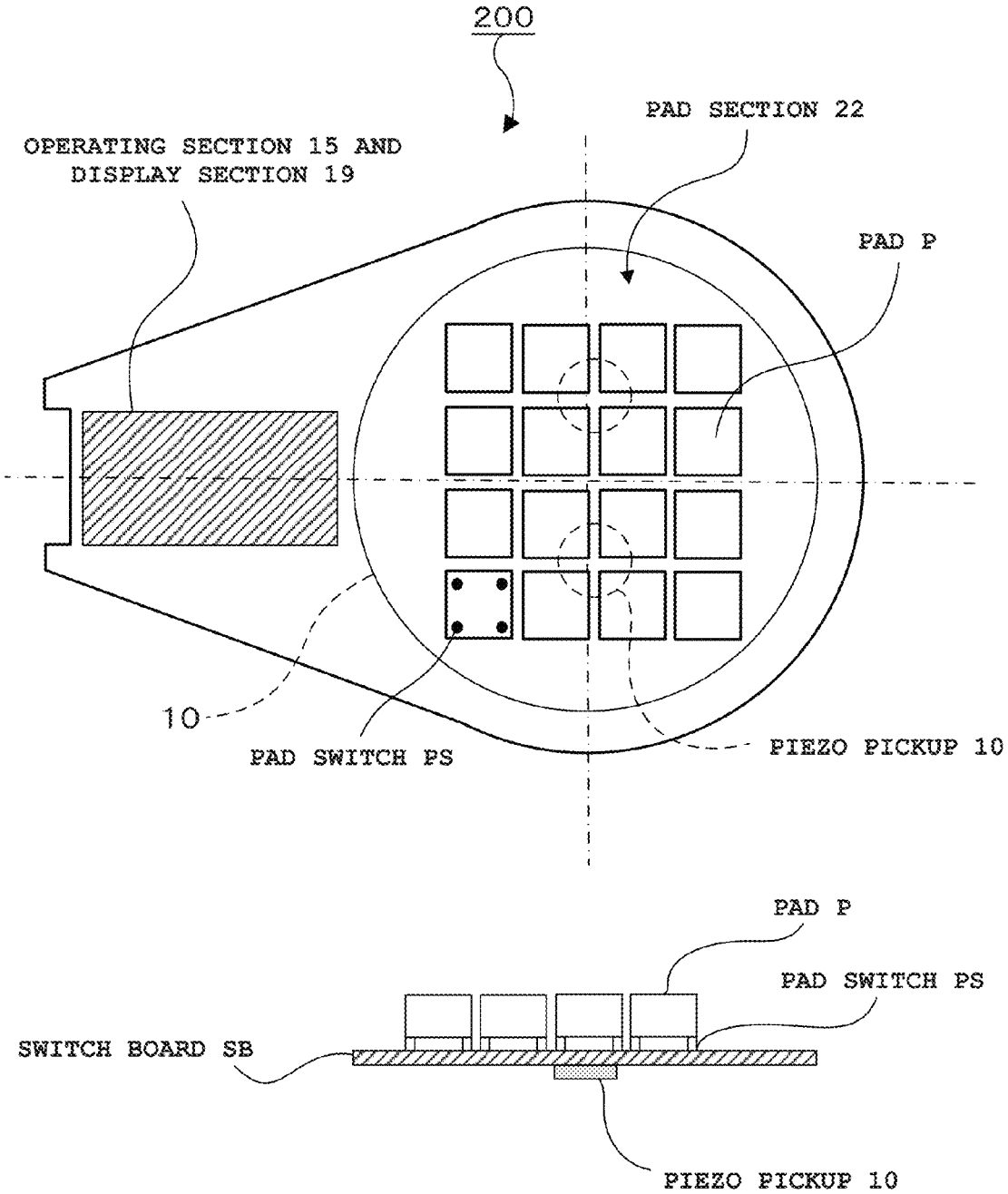
FIG. 19 is a planar view of a modification example of the second embodiment.

FIG. 19 shows a modification example of the second embodiment. In FIG. 19, a planar and sectional view for describing the arrangement positions of the piezo pickups 10 in the modification example is shown. Note that components in FIG. 19 which are equivalent to those of the second embodiment in FIG. 12 are provided with the same reference numerals and descriptions therefor are omitted.

In this modification example, two piezo pickups 10 are provided for a plurality of pads (operators). Also, on the switch board thereof, pad switches (carbon materials) are provided corresponding to projecting portions underneath each pad. In FIG. 19, four projecting portions are provided underneath the pad, and four pad switches are provided on portions of the switch board corresponding to these four projecting portions. On the projecting portions underneath the pads, carbon materials are provided. By the carbon materials coming in contact with the carbon materials of the pad switches on the switch board, ON and Off states are switched. Once any of the four switches of one operator is operated (when the carbon materials come in contact with each other), this operator is judged to have been operated, and enters an ON or Off state. Note that the pad switch (operation detector) may be provided singly for one operator, or be provided plurally as shown in this modification example. That is, the pad switch (operation detector) is only required to detect an operation performed on a certain area (operator). In this case, the distance L to be registered on the distance table DT may be the distance between an operated operator (area) and the piezo pickup 10.

Note that, although the pads in the modification example are independent from one another, they may be formed integrally.

Note that, in a structure where the loudspeakers SP are provided as in the electronic musical instrument 100 according to the first embodiment and the electronic percussion instrument 200 according to the second embodiment, the piezo pickup 10 may make an erroneous detection of vibrations of the housing due to sound emission from the loudspeakers SP. Accordingly, a configuration may be adopted in which the detection sensitivity of the piezo pickup 10 is changed in accordance with the sound volume level of a sound emitted from the loudspeakers SP, or a structure may be adopted which includes a correcting section for cutting a bias component included in a detection signal of the piezo pickup 10.

Also, in the embodiments of the present invention, control data (the control data TD and the pad data PD) is calculated by multiplying piezo input envelope waveform data by a normalization factor. However, a configuration may be adopted in which control data (the control data TD and the pad data PD) registered in advance is acquired from a table where acquired piezo input envelope waveform data and values of a normalization factor and the like have been registered, in accordance with the acquired piezo input envelope waveform data and the value of the normalization factor and the like. Moreover, in the embodiments of the present invention, distance L registered corresponding to the key number of a depressed key is read out from the distance table DT, and a normalization factor G corresponding to this distance L is read out from the normalization factor table NT. However, a configuration may be adopted which uses a table from which a normalization factor G is directly read out based on the key number of a depressed key.

Furthermore, in the embodiments of the present invention, a piezo pickup is used for detecting a striking vibration occurred by an operation. However, in addition to the vibration, the strength or speed of pressing a key or pad may be detected. Accordingly, a sensor for detecting strength or speed may be used. For example, a distortion sensor for detecting the distortion of the board or a pressure sensor using a resistive film may be used. That is, although a sensor for detecting vibration that is a physical phenomenon is used in the present invention, a sensor capable of detecting the strength or speed of a depression operation or distortion that is a physical phenomenon may be used.

Still further, the electronic musical instrument 100 according to the first embodiment and the electronic percussion instrument 200 according to the second embodiment described above use one piezo pickup 10. Alternatively, a plurality of piezo pickups 10 (whose number is smaller than the number of operators of keys and pads) may be used, as in the modification example of the first embodiment. In this structure, each of the plurality of piezo pickups 10 may detect vibrations occurring when each of the operators (keys and pads) is operated. For example, in the case of the modification example of the first embodiment depicted in FIG. 11, each of the lower-key-area piezo pickup 10-1 and the upper-key-area piezo pickup 10-2 may detect key depression vibrations of all key switches KS. Also, each piezo pickup may detect vibrations of operators in a range defined in advance. For example, in the case of the modification example of the first embodiment depicted in FIG. 11, the lower-key-area piezo pickup 10-1 may detect vibrations of the keys in the lower key area and the upper-key-area piezo pickup 10-2 may detect vibrations of the keys in the upper key area.

While the present invention has been described with reference to the preferred embodiments, it is intended that the invention be not limited by any of the details of the description therein but includes all the embodiments which fall within the scope of the appended claims.

What is claimed is:

1. A musical sound control device comprising:

a plurality of operation detectors which detect operations performed on a plurality of operators, respectively;

a detection element which detects a level of a physical phenomenon caused by each operation performed on the plurality of operators;

a control unit which controls a musical sound to be emitted corresponding to one of the plurality of operators detected by the plurality of operation detectors, based on (i) the detected level of the physical phenomenon and (ii) a distance between one of the plurality of operators detected by one of the plurality of the operation detectors and the detection element;

an operation manner detector which outputs a signal indicating the level of the physical phenomenon detected by the detection element; and a first table which stores a first coefficient having a value corresponding to a distance between the detection element and each of the plurality of operators, wherein the control unit reads out, from the first table, the first coefficient corresponding to one of the plurality of operators detected to have been operated by one of the plurality of operation detectors, and generates control data by correcting the signal outputted from the operation manner detector based on the read first coefficient.

2. The musical sound control device according to claim 1, wherein the control unit controls the level of the physical phenomenon detected by the detection element based on a distance between one of the plurality of operators detected to have been operated by one of the plurality of the operation detectors and the detection element, and controls the musical sound to be emitted based on the controlled level.

3. The musical sound control device according to claim 1, further comprising:

a second table which stores a second coefficient having a value corresponding to number of operators detected to have been operated by the operation detector, wherein the control unit reads out, from the second table, the second coefficient corresponding to the number of the operators detected to have been operated by the operation detector, and generates the control data by correcting the signal outputted from the operation manner detector based on the read second coefficient.

4. The musical sound control device according to claim 1, further comprising:

another table which stores a time corresponding to a distance between the detection element and each of the plurality of operators, wherein the control unit reads out, from the another table, the time corresponding to one of the plurality of operators detected to have been operated by one of the plurality of operation detectors, and generates the control data at a timing corresponding to the read time.

5. The musical sound control device according to claim 1, wherein the detection element is plurally provided in the musical sound control device, and a number of the detection elements is less than a number of the plurality of operators.

6. The musical sound control device according to claim 1, wherein the musical sound is at least one of a pitch and a tone color.

7. An electronic musical instrument comprising:

a plurality of operators;

the musical sound control device according to claim 1; and a sound source which emits the musical sound controlled by the musical sound control device at a pitch corresponding to an operated one of the operators.

8. An electronic musical instrument comprising:

a plurality of operators;

the musical sound control device according to claim 1; and a sound source which emits the musical sound controlled by the musical sound control device in response to operation of one of the operators.

9. A musical sound control method for a musical sound control device including a plurality of operation detectors each of which detects whether one of a plurality of operators has been operated and a detection element which detects a level of a physical phenomenon caused by operation of at least one of the plurality of operators, said method comprising:

acquiring the level of the physical phenomenon related to an operator detected by the detection element; and controlling a musical sound to be emitted, based on the detected level of the physical phenomenon and a distance between the operator detected to have been operated by the operation detector and the detection element, wherein the controlling comprises reading out, from a first table which stores a first coefficient having a value corresponding to a distance between the detection element and each of the plurality of operators, the first coefficient corresponding to one of the plurality of operators detected to have been operated by one of the plurality of operation detectors, and generating control data based on the read first coefficient.

10. A non-transitory computer-readable storage medium having a program stored thereon that is executable by a computer for a musical sound control device including a plurality of operation detectors each of which detects whether one of a plurality of operators has been operated and a detection element which detects a level of a physical phenomenon caused by operation of at least one of the plurality of operators, the program being executable by the computer to perform functions comprising:

processing for acquiring the level of the physical phenomenon related to an operator detected by the detection element; and processing for controlling a musical sound to be emitted, based on the detected level of the physical phenomenon and a distance between the operator detected to have been operated by the operation detector and the detection element, wherein the processing for controlling comprises processing for reading out, from a first table which stores a first coefficient having a value corresponding to a distance between the detection element and each of the plurality of operators, the first coefficient corresponding to one of the plurality of operators detected to have been operated by one of the plurality of operation detectors, and processing for generating control data based on the read first coefficient.

11. A musical sound control device comprising:

a plurality of operation detectors which detect operations performed on a plurality of operation areas located differently from one another, respectively;

a detection element which detects a level of a physical phenomenon generated by an operation performed on one of the plurality of operation areas;

a control unit which controls a musical sound to be emitted based on (i) a distance between one of the plurality of operation areas detected to have been operated by one of the plurality of operation detectors and the detection element and (ii) the level of the physical phenomenon detected by the detection element;

an operation manner detector which outputs a signal indicating the level of the physical phenomenon detected by the detection element; and a first table which stores a first coefficient having a value corresponding to a distance between the detection element and each of the plurality of operators, wherein the control unit reads out, from the first table, the first coefficient corresponding to one of the plurality of operators detected to have been operated by one of the plurality of operation detectors, and generates control data by correcting the signal outputted from the operation manner detector based on the read first coefficient.

12. A musical sound control device comprising:

a plurality of operation detectors which detect operations performed on a plurality of operators, respectively;

a detection element which detects a level of a physical phenomenon caused by each operation performed on the plurality of operators;

a control unit which controls a musical sound to be emitted corresponding to one of the plurality of operators detected by the plurality of operation detectors, based on (i) the detected level of the physical phenomenon and (ii) a distance between one of the plurality of operators detected by one of the plurality of the operation detectors and the detection element;

an operation manner detector which outputs a signal indicating the level of the physical phenomenon detected by the detection element; and a table which stores a coefficient having a value corresponding to a number of operators detected to have been operated by the operation detector, wherein the control unit reads out, from the table, the coefficient corresponding to the number of the operators detected to have been operated by the operation detector, and generates control data by correcting the signal outputted from the operation manner detector based on the read coefficient.

13. The musical sound control device according to claim 12, wherein the detection element is plurally provided in the musical sound control device, and a number of the detection elements is less than a number of the plurality of operators.

14. The musical sound control device according to claim 12, wherein the musical sound is at least one of a pitch and a tone color.

15. An electronic musical instrument comprising:

a plurality of operators;

the musical sound control device according to claim 12; and a sound source which emits the musical sound controlled by the musical sound control device in response to operation of one of the operators.

* * * * *